US008973515B2

(12) United States Patent
Metcalf

(10) Patent No.: US 8,973,515 B2
(45) Date of Patent: Mar. 10, 2015

(54) WAKEBOARD TOWER SYSTEM

(75) Inventor: Robert Metcalf, Lenoir City, TN (US)

(73) Assignee: Xtreme Marine Corporation, Maryville, TN (US)

( * ) Notice: Subject to any disclaimer, the term of this patent is extended or adjusted under 35 U.S.C. 154(b) by 282 days.

(21) Appl. No.: 12/963,953

(22) Filed: Dec. 9, 2010

(65) Prior Publication Data

US 2011/0139057 A1 Jun. 16, 2011

Related U.S. Application Data

(60) Provisional application No. 61/285,284, filed on Dec. 10, 2009.

(51) Int. Cl.
*B63B 17/00* (2006.01)
*B63B 15/00* (2006.01)

(52) U.S. Cl.
CPC ..... *B63B 15/00* (2013.01)
USPC ..... 114/364; 114/343

(58) Field of Classification Search
USPC ..... 114/356, 90, 84, 253, 361, 79 R, 79 W, 114/80, 81, 65 R, 71, 65 A, 201 R, 173–178; 52/86, 87, 633–697, 88, 483.1, 239, 52/36.1; D12/317
See application file for complete search history.

(56) References Cited

U.S. PATENT DOCUMENTS

| | | | | | |
|---|---|---|---|---|---|
| 104,474 | A * | 6/1870 | Marshall | 114/176 |
| 1,648,445 | A * | 11/1927 | Crowell | 114/177 |
| 2,152,605 | A * | 3/1939 | Ragsdale et al. | 52/210 |
| 3,121,924 | A * | 2/1964 | Beisel | 52/656.6 |
| 3,179,983 | A * | 4/1965 | Webber et al. | 52/376 |
| 3,666,605 | A * | 5/1972 | Meyer et al. | 428/38 |
| 3,724,595 | A | 4/1973 | Green | |
| 4,892,054 | A * | 1/1990 | Davidson | 114/357 |
| 5,052,326 | A | 10/1991 | Wiggen et al. | |
| 5,603,644 | A * | 2/1997 | Kobayashi et al. | 440/86 |
| 5,964,173 | A * | 10/1999 | Erskine et al. | 114/176 |
| 6,192,819 | B1 | 2/2001 | Larson et al. | |
| 6,374,762 | B1 | 4/2002 | Larson et al. | |
| RE37,823 | E | 9/2002 | Larson et al. | |
| D462,932 | S | 9/2002 | Larson | |
| D480,349 | S | 10/2003 | Carlton | |
| 6,666,159 | B2 | 12/2003 | Larson et al. | |
| D486,441 | S | 2/2004 | Metcalf | |
| D489,314 | S | 5/2004 | Metcalf | |
| 6,792,888 | B1 | 9/2004 | Metcalf | |
| 6,925,957 | B2 | 8/2005 | Schultz | |
| 6,986,321 | B2 | 1/2006 | Metcalf | |
| 7,013,830 | B1 * | 3/2006 | Willis | 114/361 |
| 7,017,509 | B2 | 3/2006 | Schultz | |
| 7,219,617 | B2 | 5/2007 | Metcalf | |
| 7,263,944 | B1 * | 9/2007 | Smith et al. | 114/253 |
| 7,299,761 | B2 | 11/2007 | Larson et al. | |
| 7,392,758 | B2 | 7/2008 | Metcalf | |
| 7,798,089 | B2 * | 9/2010 | McKeand | 114/364 |
| 2006/0092649 | A1 * | 5/2006 | Bynum | 362/488 |
| 2007/0137554 | A1 | 6/2007 | Metcalf | |
| 2009/0031643 | A1 * | 2/2009 | Allen | 52/86 |

* cited by examiner

*Primary Examiner* — Edwin Swinehart
(74) *Attorney, Agent, or Firm* — Luedeka Neely Group, P.C.

(57) ABSTRACT

A boat tower and methods for making in which the tower is made of one or more composite members, each including a structural member and molded decorative members attached to opposite sides of the structural member, resulting in a tower system that requires substantially less finishing of the surfaces of the structural members as compared to conventional boat towers.

15 Claims, 6 Drawing Sheets

WAKEBOARD TOWER SYSTEM

CROSS-REFERENCE TO RELATED APPLICATION

This application claims priority to U.S. Provisional Application Ser. No. 61/285,284, filed Dec. 10, 2009, and entitled "Wakeboard Tower System," incorporated by reference herein in its entirety.

FIELD

The present disclosure relates to boat towers, such as wakeboard towers, radar arches, and the like. More particularly, the disclosure relates to boat towers in the nature of wakeboard towers which utilize cast structural members.

BACKGROUND

Structures such as wakeboard towers, radar arches and other arch systems of the type found on boats are conventionally made using as structural members aluminum tubing of various cross-sectional configurations welded together. The use of such tubing members requires substantial hand-treatment in the nature of bending, sanding, polishing, painting, powder coating, and the like to provide the tower structure with an aesthetically pleasing shape and smooth finish. In addition to these shortcomings, the use of structural members made from tubing also limits the compatibility of the tower for incorporating other aesthetic features as well as other components, particularly electrical components such as speakers, illumination, and the like.

The present disclosure relates to improved arch or tower structures which utilizes structural members that do not require bending of the components or significant buffing, polishing, and the like in the manner of tubing and are thus less labor intensive to produce. The structural members may also readily include additional aesthetic features as well as components such as speakers, illumination, and the like.

SUMMARY

The above and other needs are met by a composite member especially suitable for use in a wakeboard tower. In one aspect of the disclosure, the composite member includes a structural member having molded decorative members attached to opposite sides of the structural member. The structural member may be, for example, a cast aluminum structural member, a fabricated beam structural member, or a tubular structural member.

In an additional aspect of the disclosure, the structural member includes a pair of spaced apart side rails, between which spans an intermediate section, with the decorative members substantially covering the intermediate section and adjacent surfaces of the side rails so that such portions of the structural member do not require sanding or finishing.

In another aspect of the disclosure, the decorative members are vacuum formed plastic panels or fiberglass or plastic sheet panels. In certain embodiments, the panels include electrical speakers or electrical lights or other electrical components integrated therein.

In a further aspect of the disclosure, the decorative members may be removed from the wakeboard tower provided by the composite member and replaced with other decorative members.

The disclosure also relates to a method of manufacturing a boat tower, including the steps of: providing a structural member having exterior surfaces requiring finishing in order to have suitable aesthetics; providing decorative members having a desired aesthetic appearance; and attaching the decorative members to opposite sides of the structural member so as to substantially cover the exterior surfaces of the structural member to yield a composite boat tower structure.

The resulting composite boat tower structure has suitable aesthetics and requires substantially less finishing of the surfaces of the structural members as compared to conventional boat tower structures.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
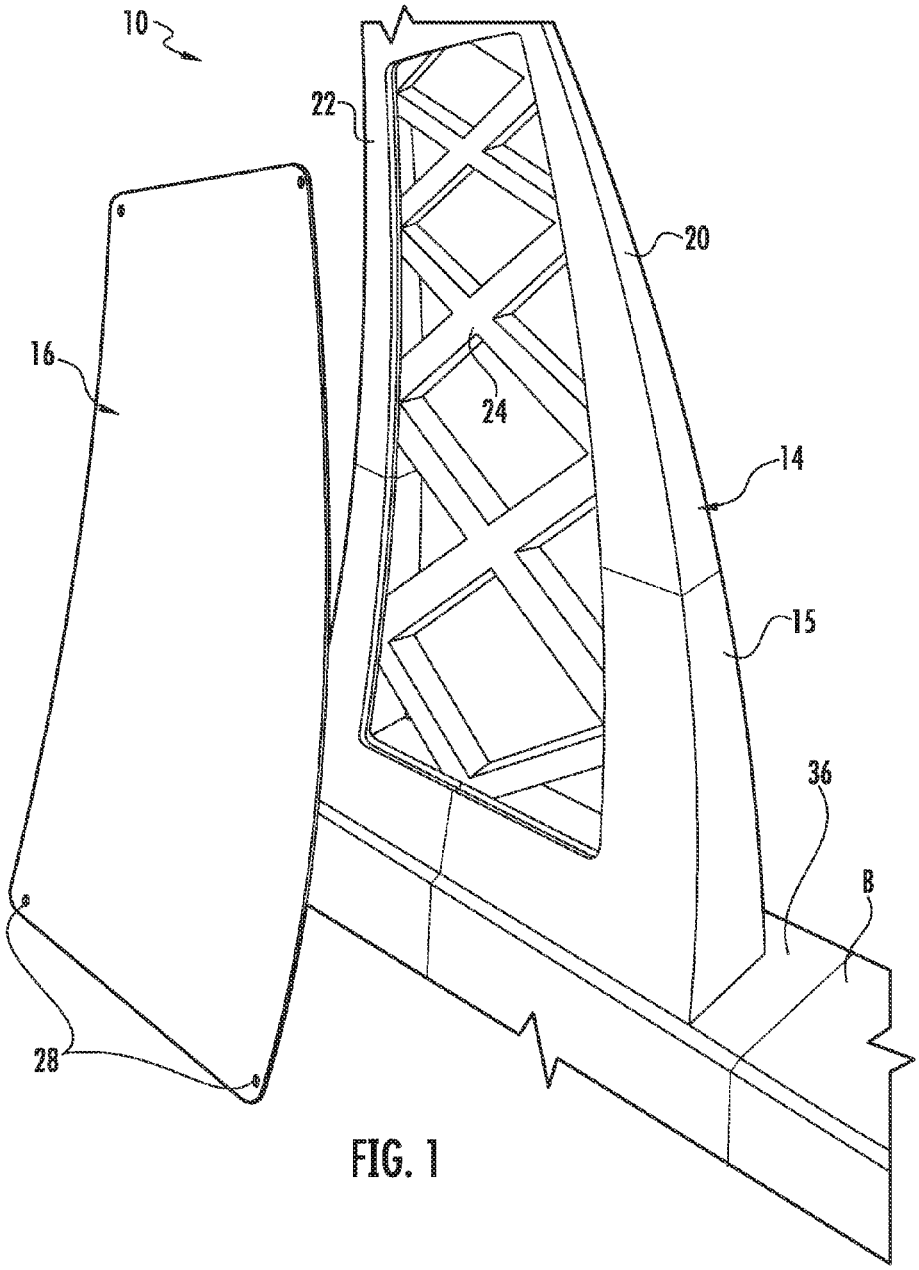
FIGS. 1 and 2 are exploded perspective views of structural members and decorative members for use in providing wakeboard towers according to the disclosure.
Figure 4:
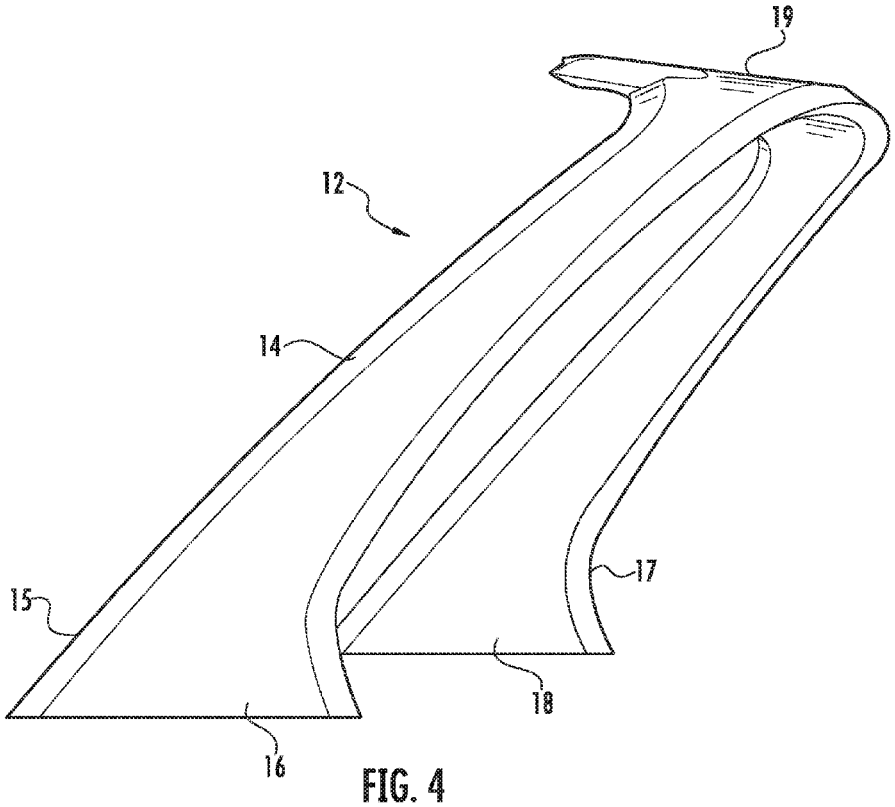
FIG. 4 is a perspective view of a wakeboard tower according to the disclosure.
Figure 5:
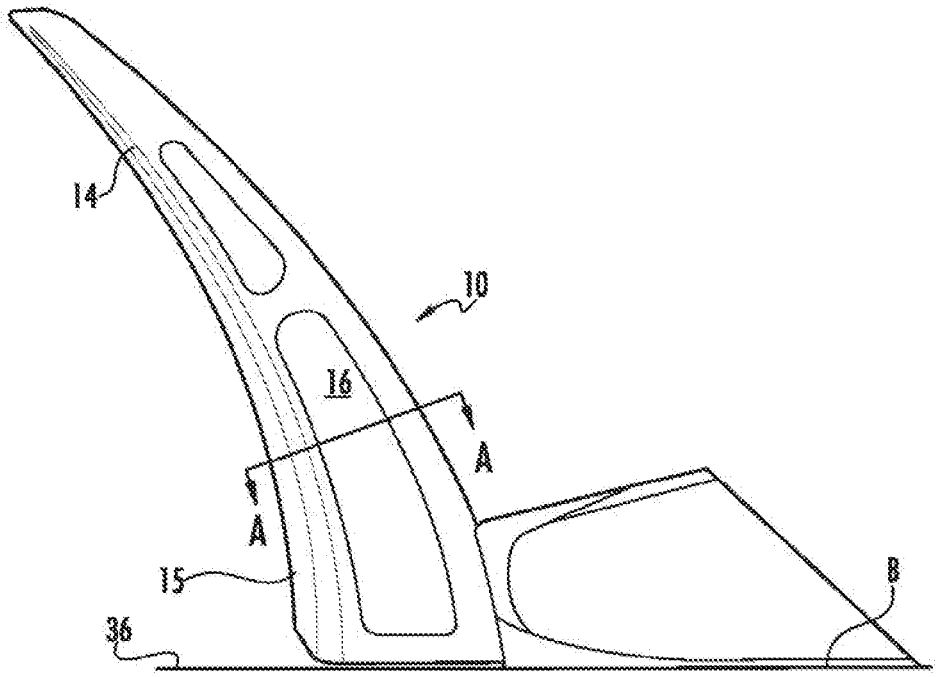
FIG. 5. is a side view of a portion of a wakeboard tower according to the disclosure.

With reference to the drawings, the disclosure relates to a composite member 10 especially suitable for use in a wakeboard tower 12. As shown in FIGS. 1 and 4, a typical wakeboard tower includes at least two legs 15 and 17 extending upwardly from opposite sides of a boat B, such as from the gunwales 36. A cross member 19 is attached to upper portions of the legs 15 and 17 and spans above and across the width of the boat B. The composite member 10 includes a structural member 14 having decorative members 16 and 18 attached to opposite sides of the structural member 14. The composite member 10 is mountable to a structure, such as a boat B (FIG. 1).

The composite member 10 includes a structural member 14 having decorative members 16 and 18 attached to opposite sides of the structural member 14. The composite member 10 advantageously minimizes sanding and finishing typical to conventional wakeboard tower construction, while offering decorative appearances atypical to conventional wakeboard towers, and which may be customized and changed.

While the structures are described herein in the context of a wakeboard tower, it will be understood that the structures are applicable to other raised structures, such as radar arches, flying bridges, and the like used on boats.

In one embodiment, the structural member 14 is a unitary member of cast construction. For example, the structural member 14 may be of aluminum or polymeric cast construction or a fabricated beam structural member. The use of a cast member is desirable to avoid the need for bending as is required in tubing structures or other structures having a plurality of joined members. However, it will be appreciated that tubular structural members assembled from a plurality of smaller members joined together as by bolts or other fasteners, or welding, such as is common for tubular structural members, may be used, with the decorative members 16 and 18 configured for use with a tubular structural member if desired. In this regard, structures according to the disclosure also advantageously enable elimination of a substantial portion, if not all, of the need for sanding, polishing, painting, and powder coating of the tubular or other assembled member. For the purpose of describing a preferred embodiment, the structural member 14 is described in the context of a unitary cast member.

The structural member 14 includes a pair of spaced apart side rails 20 and 22, between which spans an intermediate section 24. The intermediate section 24 may be formed having a lattice or oval strut design, as a thin wall with open port holes, or using various other designs which further reduce materials costs and weight of the structural member 14. In certain alternate embodiments, the intermediate section 24 between the side rails 20 and 22 may substantially be void of any structure.

Figure 3:
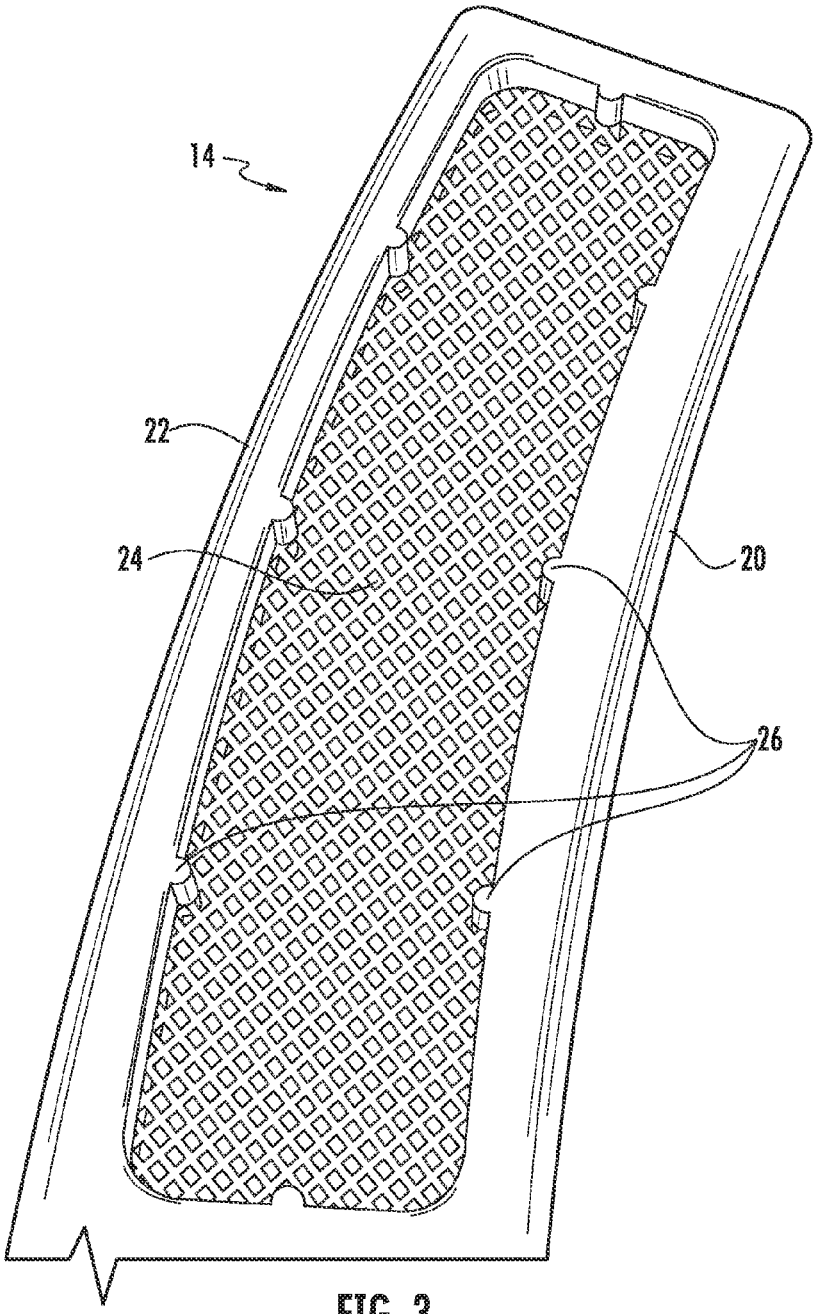
FIG. 3 is a perspective view of a structural member according to the disclosure.

To receive the decorative members 16 and 18 in a snap fit or other fastened manner, the structural member 14, or other structural member used if not cast, may include attachment features, such as projections 26 (FIG. 3) to promote a snap-fit engagement of the decorative members 16 and 18. The projections 26 are preferably located on the intermediate section 24 of the structural member 14. In this regard, it will be understood that the decorative members 16 and 18 may also be reliably mounted to withstand use conditions of wakeboard towers, but preferably removably mounted onto the structural member 14 utilizing adhesives, hook and loop material, fasteners, and the like.

The exterior surfaces of the side rails 20 and 22 will typically be visible and represent surfaces that may be sanded and finished, such as by painting or powder coating. The remaining surfaces of the side rails 20 and 22 and the intermediate section 24 are covered by the decorative members 16 and thus are not sanded or finished, thus greatly reducing the amount of surface area of the side rails 20 and 22 that are sanded and finished. However, if desired it will be understood that the decorative members 16 and 18 may be configured to cover substantially all exterior surfaces of the side rails 20 and 22 of the structural member 14, thus virtually eliminating all need for sanding or other finishing.

Figure 6:
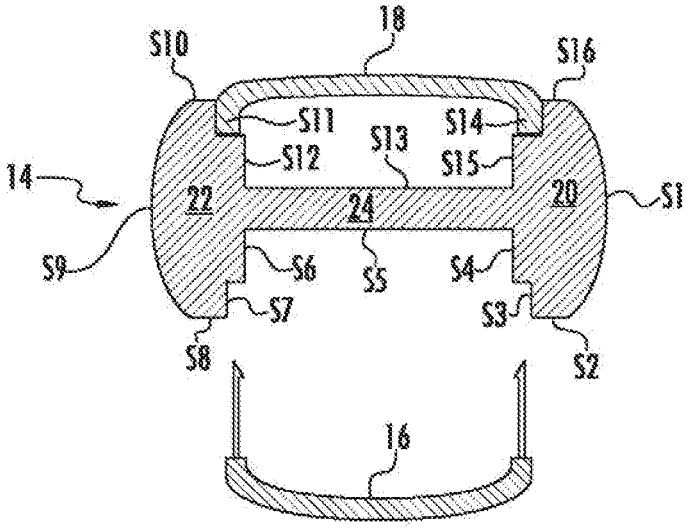
FIG. 6 is a cross-sectional view taken along line A-A of FIG. 5.

For the purpose of example, and with reference to FIG. 6, the structural member 14 has surfaces S1-S16. However, when the decorative members 16 and 18 shown in FIGS. 1-6 are used, only surfaces S1, S2, and S16 associated with the rail 20 and surfaces S8, S9, and S10 associated with the rail 22 are exposed and typically need to be sanded and finished to provide the desired appearance and aesthetics. The majority of the surfaces, i.e., the surfaces S3-S7 and S11-S15, are covered by the decorative members 16 and 18 and need not be significantly sanded and/or finished. In this regard, it will be understood that FIG. 6 is a cross-sectional view showing the decorative member 18 not installed and the other decorative member 16 installed on the structural member 14.

The decorative members 16 and 18 may be the same or different to one another and may represent the same or different aesthetic appearances and functional structures. For example, the members 16 and 18 may be vacuum formed plastic panels, or fiberglass or plastic sheet panels incorporating various color schemes, graphics, or other visual effects, such as lenticular materials and printing that provides a three-dimensional visual effect. The decorative members 16 and 18 may have a fabric or other finish, with the members 16 and 18 being of relatively lightweight and rigid construction. The decorative members 16 and 18 are preferably removably mounted to the structural members 14 to enable them to be readily changed out if desired so that another decorative or aesthetic expression may be presented on either or both sides of the structural member 14.

Figure 2:
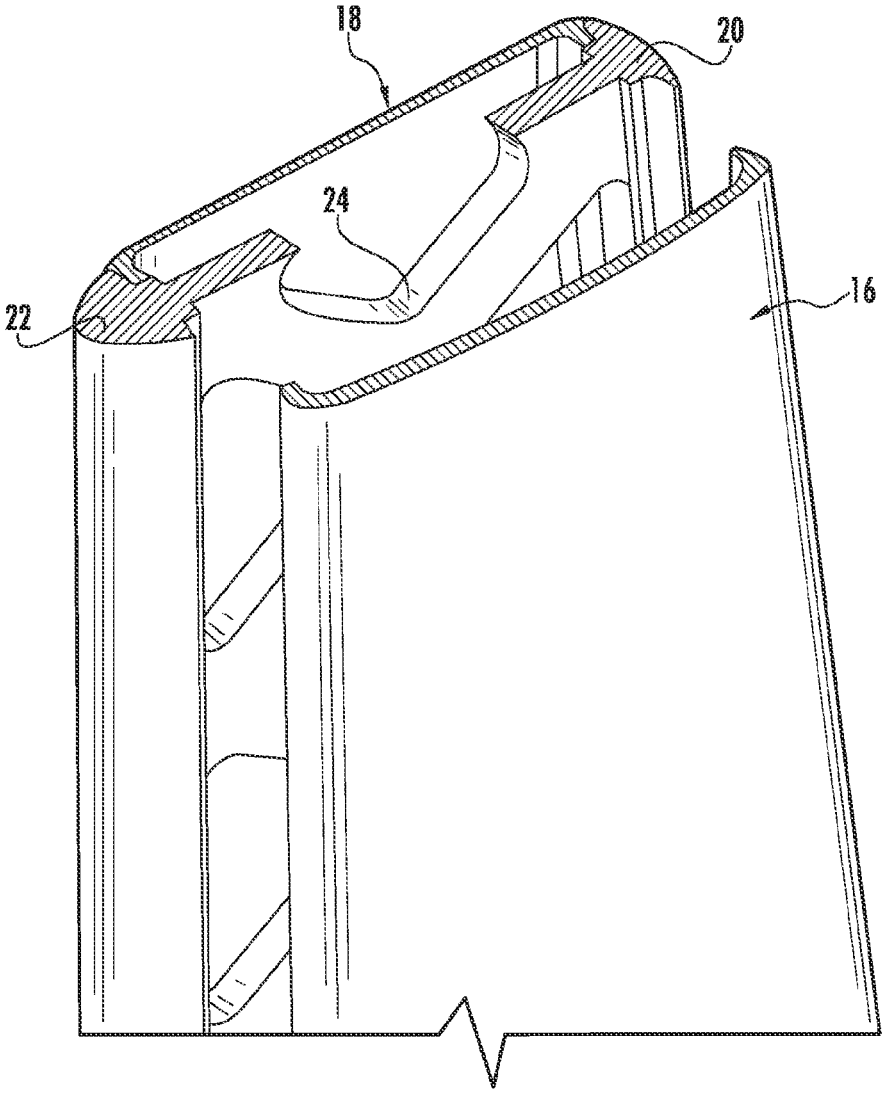

As mentioned above, various snap-fit or other fastening arrangements may be utilized to attach the decorative members 16 and 18 to the structural member 14. In this regard, it will be understood that the attachment features may be provided on the decorative members 16 and 18 or the structural member 14 or both. For example, the decorative member 16 is shown (FIG. 1) having apertures 28 for passage of fasteners, such as screws or the like. With reference to FIGS. 2 and 6, it will be seen that interior surfaces of the side rails 20 and 22 adjacent the intermediate section 24 are contoured, with the decorative member 16 having matching or corresponding contours to yield a snap-fit relationship. The decorative members 16 and 18 may also be permanently attached if desired, as by adhesives, sonic welding, overmolding, or the like.

Figure 7:
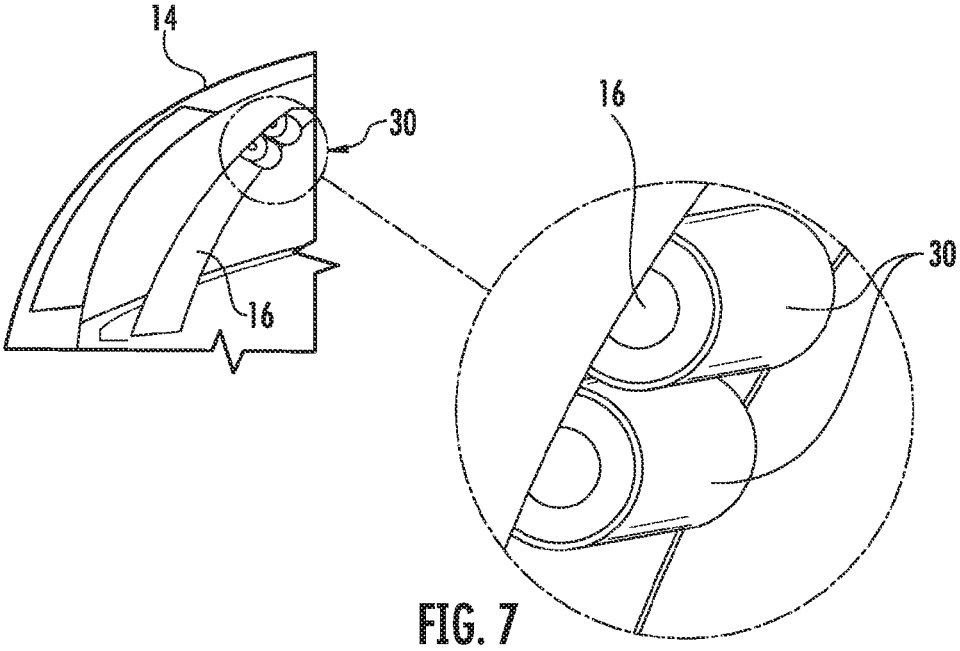
FIG. 7 depicts a wakeboard tower according to the disclosure and which incorporates speakers with the decorative member.
Figure 8:
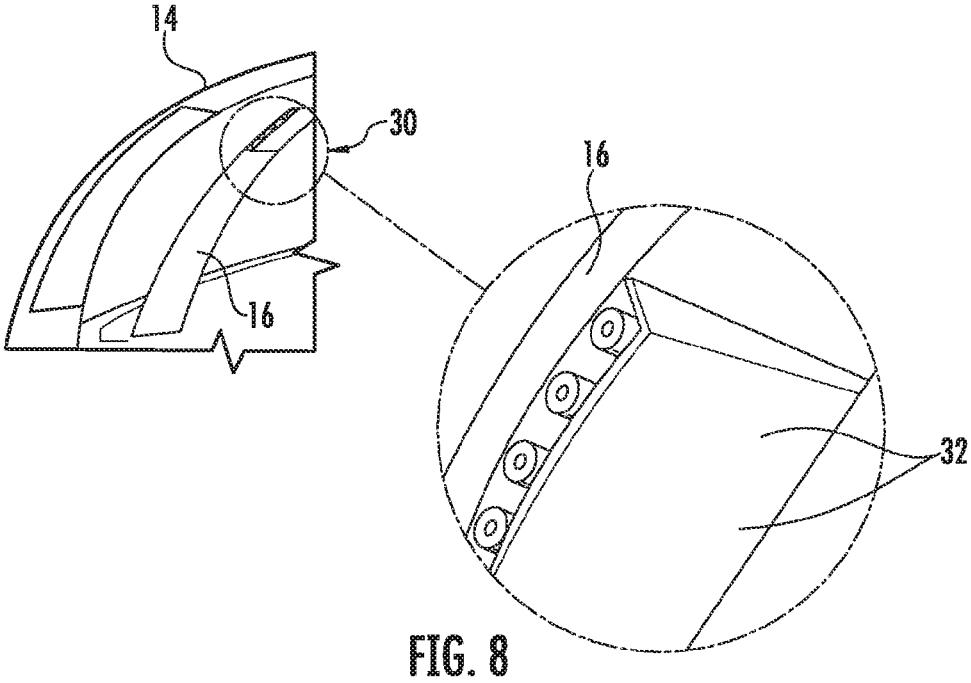
FIG. 8 depicts a wakeboard tower according to the disclosure and which incorporates lighting elements with the decorative member.

The decorative members 16 and 18 may also incorporate other components, including electrical components such as speakers, illumination, and the like. For example, FIG. 7 shows one of the decorative members 16 or 18 having a plurality of audio speakers 30 located thereon, and FIG. 8 shows one of the decorative members 16 or 18 having a plurality of illumination devices 32, such as electrical lights or light emitting diodes, located thereon. The wiring for the speakers 30 or the illumination devices 32 may be located either within the decorative member 16 or 18 or on the back side thereof so as to be hidden from view.

Utilizing the composite members 10 in accordance with the disclosure to manufacture wakeboard towers enables significant reductions in the labor needed to manufacture wakeboard towers. For example, it is believed that towers made using the composite members 10 involve only about 10 to 20 percent of the handwork (sanding and finishing) required in the manufacture of conventional wakeboard towers. As will be appreciated, this results in considerable economy. The towers according to the disclosure also have substantial advantages in that customized decorative appearances may be readily provided and repeatedly changed if desired. Also, the towers may incorporate other components, such as electrical components including speakers and lighting in an integrated manner. This is advantageous both from an ease of installation and incorporation standpoint, as well as an aesthetic standpoint.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated.

What is claimed is:

1. A boat comprising a substantially U-shaped wakeboard tower comprising a first leg extending substantially upwardly from a first side of the boat, a second leg extending substantially upwardly from a second side of the boat, and a cross member bridging an upper portion of the two legs, each leg having a pair of spaced apart side portions forming a space therebetween, an intermediate recessed wall on at least one side of each leg spanning the entirely of the space, and a removable panel attached to each leg so that the intermediate recessed wall is covered by the removable panel, wherein the side portions and intermediate recessed wall have a unitary construction such that they are permanently affixed to each other.

2. The boat of claim 1, wherein the removable panel is attached to a first side of each leg and a second removable panel is attached to a second side of each leg.

3. The boat of claim 1, wherein the removable panel is a plastic panel.

4. The boat of claim 3, wherein the plastic panel includes electrical speakers or electrical lights or other electrical components integrated therein.

5. The boat of claim 1, wherein the removable panel may be removed from the legs and replaced with other removable panels.

6. The boat of claim 2, wherein the removable panels do not cover a substantial portion of the exterior surfaces of the side rails.

7. The boat of claim 1, wherein the intermediate recessed wall comprises a lattice or strut design.

8. A wakeboard tower, comprising: at least two legs comprising a pair of spaced apart side portions forming a space therebetween and an intermediate recessed wall spanning the entirety of the space between the side portions, an upper cross member connected to upper portions of the legs wherein the upper cross member is sized to span across a width of a boat, first removable panels attached to a first side of each leg to cover at least a portion of the intermediate recessed wall and second removable panels attached to a second side of each leg that is opposite the first side of each leg, wherein the legs and upper cross member form a substantially U-shaped wakeboard tower, wherein the side portions and intermediate recessed wall have a unitary construction such that they are permanently affixed to each other.

9. The wakeboard tower of claim 8, wherein the panels substantially cover the entirety of the intermediate recessed portions.

10. The wakeboard tower of claim 8, wherein the intermediate recessed portion comprises a wall that has a thickness less than the thickness of the side portions.

11. The wakeboard tower of claim 8, wherein at least one of the panels comprises electrical speakers or electrical lights or other electrical components integrated therein.

12. The wakeboard tower of claim 8, wherein the intermediate recessed wall has an unfinished condition.

13. A method of manufacturing a substantially U-shaped wakeboard tower comprising at two legs and a cross member attached to an upper portion of the two legs, comprising the steps of:

casting the legs of the wakeboard tower, the legs having a pair of spaced apart side portions and an intermediate recessed portion spanning an entirety of a space between, the spaced apart side portions and the intermediate recessed portion having a unitary construction such that they are permanently affixed;

attaching a removable panel to at least one side of each leg so that it covers the intermediate recessed portion;

finishing the portions of the leg that are not covered by the removable panels without finishing the intermediate recessed portion.

14. The method of claim 13, wherein the removable panels are plastic or fiberglass panels.

15. The method of claim 14, wherein the panels include electrical speakers or electrical lights or other electrical components integrated therein.

* * * * *